US005395175A

United States Patent [19]

Bontoux et al.

[11] Patent Number: 5,395,175

[45] Date of Patent: Mar. 7, 1995

[54] DISPENSER HAVING A HEATING RESERVOIR FOR THERMOPLASTIC PRODUCTS, IN PARTICULAR DEPILATORY WAX

[75] Inventors: Daniel Bontoux, Saint Genis Laval; Monique Paget, Caluire et Cuire, both of France

[73] Assignee: SEB S.A., Selongey, France

[21] Appl. No.: 132,957

[22] Filed: Oct. 7, 1993

[30] Foreign Application Priority Data

Oct. 9, 1992 [FR] France ..... 92 12378

[51] Int. Cl.[6] ..... A45D 26/00; A45D 40/00

[52] U.S. Cl. ..... 401/1; 401/2; 401/220; 401/264

[58] Field of Search ..... 401/1, 2, 220, 264

[56] References Cited

U.S. PATENT DOCUMENTS

| | | | |
|---|---|---|---|
| 1,565,179 | 12/1925 | Major | 401/264 |
| 1,919,859 | 7/1933 | Phillips | 401/264 |
| 3,501,619 | 3/1970 | Buiting et al. . | |
| 3,858,985 | 1/1975 | Fiveash . | |
| 3,864,045 | 2/1975 | Hudson | 401/1 |
| 4,195,114 | 3/1980 | Crosby et al. | 428/404 |
| 4,465,073 | 8/1984 | Schwob . | |
| 4,664,900 | 5/1987 | Miyazaki et al. | 423/447.3 |
| 4,752,148 | 6/1988 | Mann | 401/220 X |
| 4,904,850 | 2/1990 | Claypool et al. . | |
| 4,957,660 | 9/1990 | Ohmae et al. | 252/500 |
| 5,283,420 | 2/1994 | Montalto | 219/432 |

FOREIGN PATENT DOCUMENTS

| | | | |
|---|---|---|---|
| 0273495 | 7/1988 | European Pat. Off. . | |
| 0368698 | 5/1990 | European Pat. Off. . | |
| 2267807 | 11/1975 | France | 401/1 |
| 2339359 | 8/1977 | France . | |
| 2623476 | 5/1989 | France . | |
| 496670 | 12/1938 | United Kingdom | 401/220 |

*Primary Examiner*—Steven A. Bratlie
*Attorney, Agent, or Firm*—Spensley Horn Jubas & Lubitz

[57] ABSTRACT

A dispenser for dispensing a thermoplastic product in a fluid state, the dispenser including: a case having a manual holding part; a reservoir composed of a wall forming an enclosure for holding a supply of the product; a product applicator disposed in proximity to a reservoir opening for receiving product in a fluid state from the reservoir, wherein at least a portion of the reservoir wall is made of an electrically conductive plastic constituting a heat source, and the dispenser further has electrodes connected to the electrically conductive plastic of the reservoir portion for delivering heating current to the heat source.

20 Claims, 4 Drawing Sheets

DISPENSER HAVING A HEATING RESERVOIR FOR THERMOPLASTIC PRODUCTS, IN PARTICULAR DEPILATORY WAX

BACKGROUND OF THE INVENTION

The present invention relates to the general field of dispensers for thermoplastic products, such as depilatory wax, salves, creams, and possibly even glues or varnishes, in which the product must be in a softened or liquid state in order to be applied, is normally stored in a solid form, and must be heated in order to be changed into a softened or liquid state.

The present invention more specifically concerns a dispenser for thermoplastic products, and in particular depilatory wax, which dispenser includes a case or housing equipped with a holding element, a reservoir for the product to be applied, which reservoir is in thermal communication with heating means, and at least one means, disposed in front of an outlet orifice of the reservoir, for applying the product.

As used herein, thermoplastic products include all types of products which are in a solid, semi-solid or highly viscous state at room temperature but which, upon being heated, will be softened or liquified sufficiently to be capable of being spread in the form of a layer. While the invention is particularly directed to a depilatory wax dispenser, it will become apparent that a product dispenser according to the invention is not limited to this specific use.

Regardless of the type of depilatory wax dispenser considered, the technique for removing hair by application of a depilatory wax consists in melting or softening a certain quantity of wax, and then applying the wax, in a liquid or softened state, in the form of a layer over the area to be treated. After the wax hardens, i.e. cools, there exists a film or sheet of cold wax which is pulled away from the treated area, with the aid of any suitable appliance, with strands of hair then being plucked from the skin due to the fact that they are lodged firmly in the wax.

In order to implement this widely used technique, distributors of hot wax ready for use are already known. These distributors are constituted by a reservoir heated by any suitable means, for example by a device analogous to a heater for baby bottles. These distributors are completed by a simple roller for spreading wax which the user introduces into the reservoir in order to form a regular coating of hot wax on the roller. This apparatus, which is rather primitive, has been found to no longer satisfy the increasingly sophisticated needs of users of depilatory wax. In these devices, the temperature to which the wax is heated for application is poorly regulated, as is the thickness of the applied wax layer. These apparatus are also known to be relatively cumbersome and the associated depilatory operation is long, tedious, often messy and frequently involves an excess consumption of wax.

Improvements in prior art devices of this type are described in French Application A-2520601. The dispenser assembly described therein includes a case or housing provided with heating receptacles in which are inserted dispensers that are intended to be held by the user. Each dispenser is provided with an internal reservoir intended to contain a supply of depilatory wax in solid form and with a wax applying roller. Such a dispenser represents an improvement over previous devices, but does not completely resolve the problems associated with proper control of the temperature of the wax at the time it is applied. In effect, if the temperature of the wax is satisfactory when the user initially withdraws the dispenser from the heating receptacle, it will inevitably occur that after a certain period of use, the wax is no longer at a suitable temperature. This leads to an increasing difficulty in applying the wax, a waste of wax and a depilatory operation which is unreliable, uneven and in any case unsatisfactory. In order to obviate these problems, the user is required to frequently return the dispenser to the housing receptacle and this prolongs the duration of the process without any added assurance of achieving an improved result.

In light of these difficulties, it has also been proposed, as disclosed, for example, in European Application A-0368698, to provide a depilatory wax dispenser in which the wax reservoir is provided with a heating resistance. To improve the ease of application of the wax, and also to achieve better temperature control, it has also been proposed to furnish the application roller of the dispenser with its own heating means. Such an arrangement assures a certain control over the temperature of the wax and prevents, in particular, a premature adherence of the wax to the reservoir wall. In the same fashion, the fact of heating the dispenser roller prevents a premature cooling of the wax during its application to the skin. On the other hand, such an arrangement present difficulties in manufacture, to the extent that it requires the presence and the installation of two separate heating means, one of which is difficult to operate and install, since it must be positioned within the application roller. In the final analysis, such a device is not highly reliable.

SUMMARY OF THE INVENTION

It is an object of the present invention to overcome the difficulties mentioned above and to furnish a dispenser of thermoplastic products whose design and construction are particularly simplified, while permitting an optimal control of the temperature of the thermoplastic product at the time it is applied.

Another object of the invention is to provide a dispenser of thermoplastic products which permits accurate control of the temperature of the totality of the mass of the thermoplastic product to be applied.

Another object of the invention is to provide a dispenser for thermoplastic products having electrical connection means which are particularly simple to fabricate while being highly reliable in operation.

Another object of the invention is to provide a dispenser for thermoplastic products in which the temperature of the product is controlled in a differential manner at different points within the reservoir.

Another object of the invention is to provide a dispenser for thermoplastic products in which thermal regulation is improved, and to provide a number of regulation modes.

Another object of the invention is to provide a dispenser for thermoplastic products provided with dispenser means permitting the product to be applied without risk of uncontrolled flow or spreading.

The above and other objects are achieved, according to the present invention, by the provision of a dispenser for thermoplastic products, in particular depilatory wax, including a case or housing associated with a holding means, a reservoir for the product to be applied, heating means in thermal communication with the reservoir, and at least one means for applying the product disposed in the vicinity of an outlet orifice of the reservoir, wherein the reservoir is formed at least in part by at least a portion of an envelope which is made of an electrically conductive plastic connected to electrodes, the envelope portion constituting the heating means.

Characteristics and advantages of the invention will become more readily apparent from a reading of the following description of an embodiment, presented by way of non-limiting example, and with reference to the following drawings.

DESCRIPTION OF THE PREFERRED EMBODIMENTS

Figure 1:
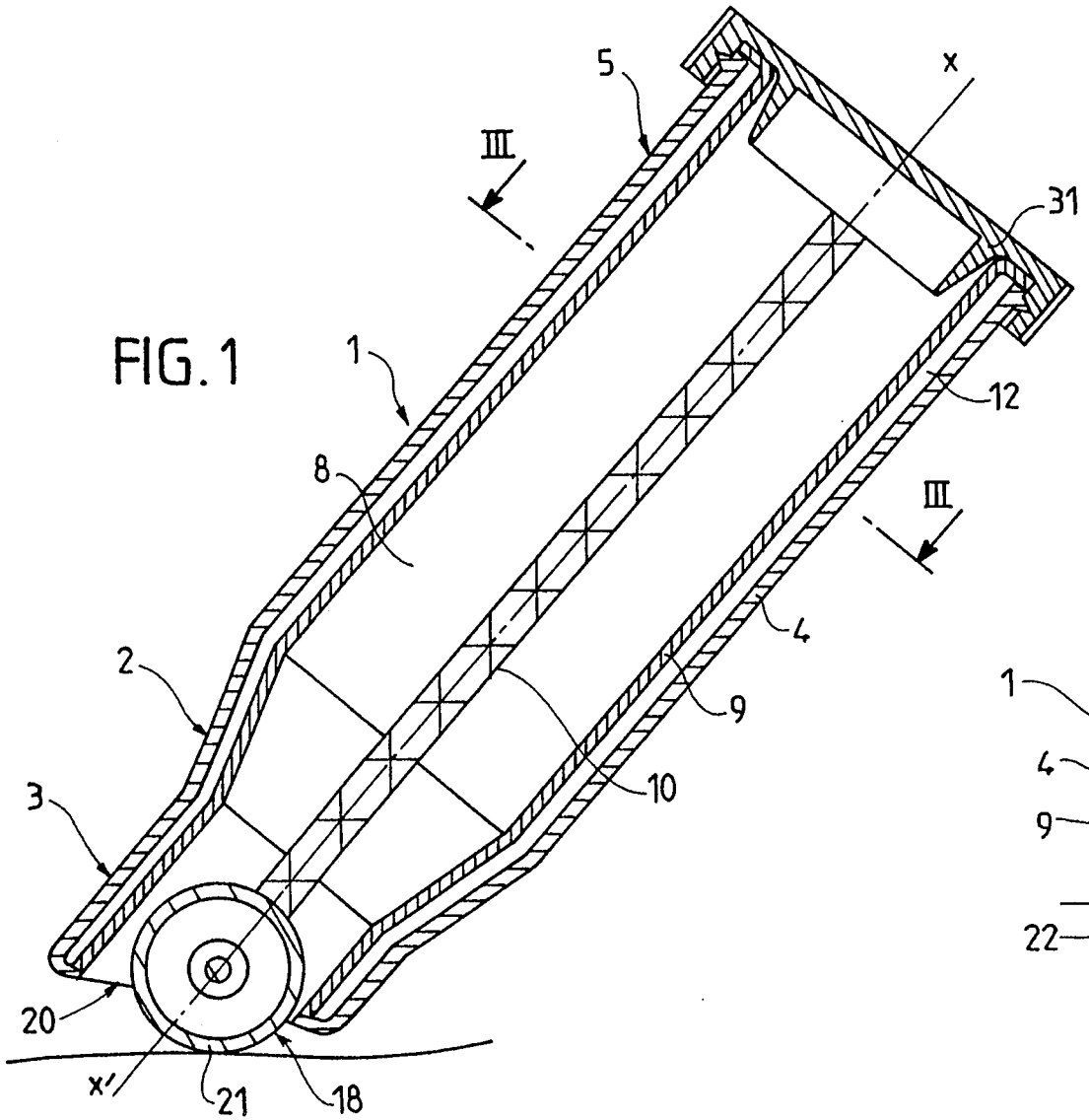
FIG. 1 is an elevational cross-sectional view illustrating the internal structure of an embodiment of the invention.

The embodiment shown in FIG. 1 includes a case or housing 1 forming an external envelope of a dispenser according to the invention. Housing 1 can have any appropriate form and can, in general, have a form similar to a cylinder with a longitudinal axis x–x' and preferably of circular cross section. The cross section of housing 1 can be unvarying along its length, or can, as shown in FIG. 1, be constructed in its lower portion to include a frusto-conic section 2 with a diameter which decreases toward the dispensing end, followed by a cylindrical lower end section 3 having a diameter smaller than that of the main portion of housing 1. Housing 1 is preferably constituted by a unitary body having an outer wall 4. Outer wall 4 preferably has a constant thickness along its length and can be made, for example, of any sufficiently rigid plastic material. Housing 1 is associated with a holding or gripping means 5 constituted in its simplest version by the upper part of housing 1. Obviously, as an alternative, housing 1 can be provided with a handle designed to be gripped comfortably by the user and thus constituting the holding means.

The dispenser according to the invention further includes a reservoir 8 for storage of the thermoplastic product before its application. Preferably, reservoir 8 is disposed within the space enclosed by case 1 and preferably has the same longitudinal axis x–x' as case 1. Reservoir 8 is limited toward the exterior by an envelope 9 preferably having an average thickness of the order of 1.5–2 mm. At least one part, or only a fraction, of envelope 9 is composed of an electrically conductive plastic material forming an electrical resistance element. Such a material can be, for example, an elastomer provided with a carbon filler. According to an advantageous embodiment of the invention, the wall of reservoir 8, or substantially the entirety of envelope 9, is made of electrically conductive plastic material. Alternatively, only one or several parts of envelope 9, for example a portion adjacent section 2 and/or section 3, can be made of electrically conductive plastic material. In effect, passage of electric current through the electrically conductive plastic material generates a heat flux which assures melting of the thermoplastic product.

Thus, electrically conductive plastic material can be provided at any geometric location or locations of the part or fraction of envelope 9 made of an electrically conductive plastic material to permit, by generation and delivery of heat, melting of the entire mass, or a significant portion of the mass, of thermoplastic material to be applied. In the same manner, by way of a further modification, only a fraction of envelope 9, defining for example a sector or concave area, whose geometric location is suitably selected, and for example in the lower part of the dispenser, could be made of electrically conductive plastic material.

The portion of envelope 9 which is not made of electrically conductive plastic material is made of a material which is a good conductor of heat. Envelope 9, or the portion of envelope 9 made of electrically conductive plastic material, is connected to a pair of electrodes 10, one of which is visible in FIG. 1, preferably constituted by two strips, bands, meshes or screens of metal disposed on envelope 9 at diametrically opposed locations with respect to axis x–x'. Strips, etc, 10 are secured by any appropriate means to the internal or external surface of envelope 9, or for example are molded into reservoir 9. As shown particularly in FIG. 12, reservoir 8 may have a transverse cross section in a form similar to a quadrilateral, and electrodes 10 may preferably extend across the entirety of two opposed lateral faces of reservoir 8 and may be extended by respective connection prongs or feet 10*a* (FIGS. 10 and 11) beyond the end of case 1 which is remote from the outlet end of reservoir 8.

Electrodes 10 can also be formed by electrolytic deposition or printing, such as silkscreen printing, of a conductive ink. Advantageously, electrodes 10 are disposed on the exterior surface of the walls of envelope 9, but can also be embedded in envelope 9, or can extend on the inner surface of envelope 9 where they will be in contact with the wax. Envelope 9, or the fraction of envelope 9 made of electrically conductive plastic material thus constitutes the heating means of the dispenser according to the invention, serving to assure continuous melting of the thermoplastic product stored in reservoir 8. Thus, envelope 9 performs the dual function of resistive heating element and product reservoir. Envelope 9 or the fraction of envelope 9 can be made of any plastic material possessing suitable resistive properties, such materials including, inter alia, silicone elastomers, polypropylene containing a carbon filler, polymers rendered conductive by a carbon filler, or even intrinsically conductive polymers, such as PVC having a polyaniline filler, for example.

Figure 3:
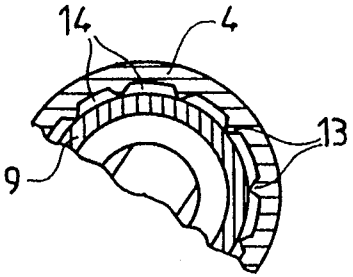
FIG. 3 is a partial cross-sectional view taken along the line III—III of FIG. 1.

According to the invention, case 1 surrounds reservoir 8 and is thermally isolated from reservoir 8, or more precisely from envelope 9, by thermal insulation means 11. The thermal insulation means can be constituted, as shown in FIG. 1, by establishing a simple dead air space 12 between case 1 and envelope 9, space 12 having an appropriate thickness. Advantageously, as shown in FIG. 3, thermal isolation means 11 can be created by providing a plurality of longitudinal ribs 13 which extend in the direction of the thickness of case 1 and project from the internal face thereof. Longitudinal ribs 13 thus bear against the external periphery of reservoir 8 and are spaced apart to delimit a series of longitudinal dead air spaces 14. It should be evident that, according to modified embodiments, ribs 13 could be formed in, and extend outwardly from, envelope 9.

Figure 2:
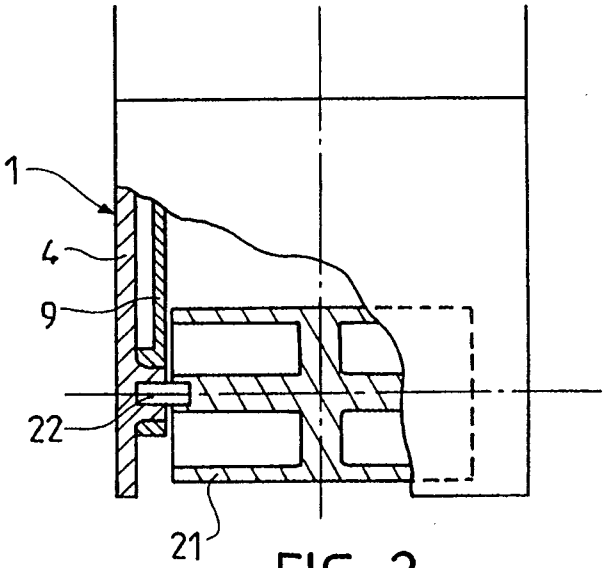
FIG. 2 is a detail view, partly in cross section, of the dispenser means of the embodiment of FIG. 1.

A dispenser of thermoplastic products according to the invention further includes a product applicator, such as an applicator 18 shown in FIGS. 1 and 2. Applicator 18 is located at an outlet opening 20 provided, as shown in FIG. 1, at the lower end of reservoir 8. Applicator 18 is advantageously constituted by a roller 21 supported, as shown most clearly in FIG. 2, by two shafts or pins 22 fixed to roller 21 and rotatably mounted in recesses which are formed in case 1 and which constitute bearings. Alternatively, roller 21 can be supported directly by envelope 9 within outlet opening 20. Roller 21 is dimensioned relative to the dimensions of opening 20 in order to cause a thin film of thermoplastic product, which according to exemplary embodiments of the invention is depilatory wax, to be formed on the surface or roller 21 and to then be applied to the user's skin. Preferably, roller 21 is mounted to be freely rotatable. However, roller 21 can also be mounted to be rotated by any conventional drive means.

Figure 5:
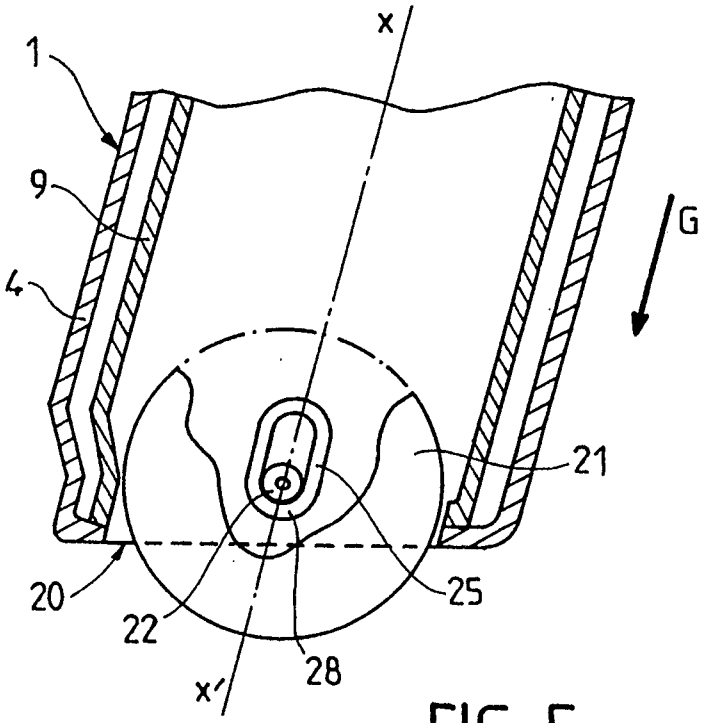
FIGS. 4 and 5 are detail views, partially in cross section, showing product applying means of a modified version of the embodiment of FIG. 1 in two operating positions.
Figure 4:
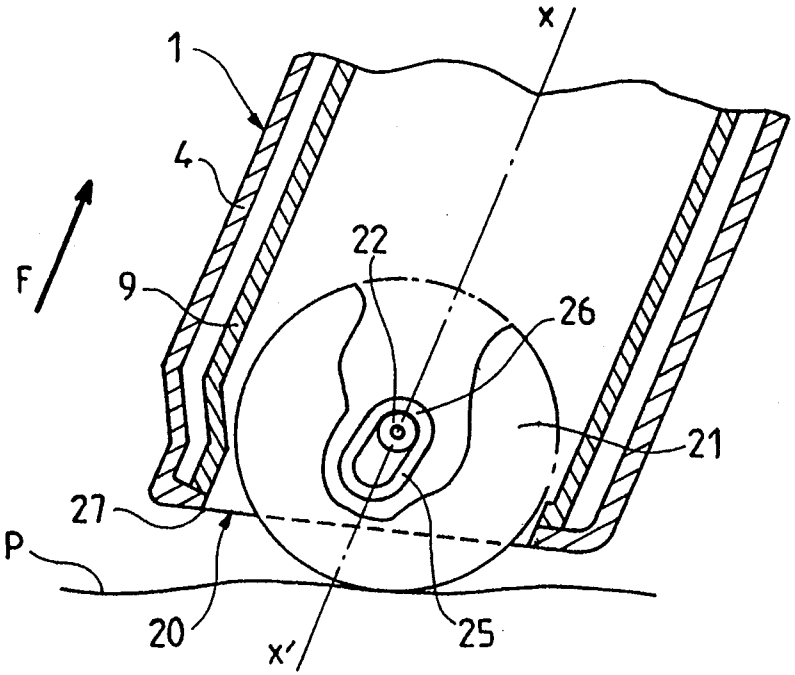

FIGS. 4 and 5 illustrate an alternative embodiment of the invention in which roller 21 is mounted in a manner to be capable of being displaced, under the force of gravity, substantially in the direction of longitudinal axis x–x'. For this purpose, shafts 22 are supported in slots 25 which are formed in case 1 or in envelope 9 and which constitute slide paths. Slots 25 have a generally oblong form with an axis of symmetry substantially parallel to longitudinal axis x–x'. The dimensional relations between opening 20 and roller 21, and particularly the diameter of roller 21, are such that when roller 21 bears against a surface P, this typically being the user's skin, roller 21 comes to occupy the abutment position shown in FIG. 4. In this position, roller 21, under the effect of a reaction force imposed by the user's skin on roller 21, moves to an abutment position in which shafts 22 are pressed against the upper extremity 26 of slots 25. Roller 21 then occupies an upper, or retracted, position. In this position, a larger gap exists between the periphery or roller 22 and an edge 27 of opening 20. Melted or softened thermoplastic product, such as wax, can then flow out of the dispenser.

FIG. 5 shows roller 21 in a lower, or extended, position, which is achieved when roller 21 is not pressing against the user's skin, and is thus free to move, under the influence of the force of gravity, to a position in which shafts 22 come to bear against the lower extremities 28 of slots 25. In this position, the dimensional relations between roller 21 and opening 20 are such that roller 21 can substantially completely block opening 20.

Figure 6:
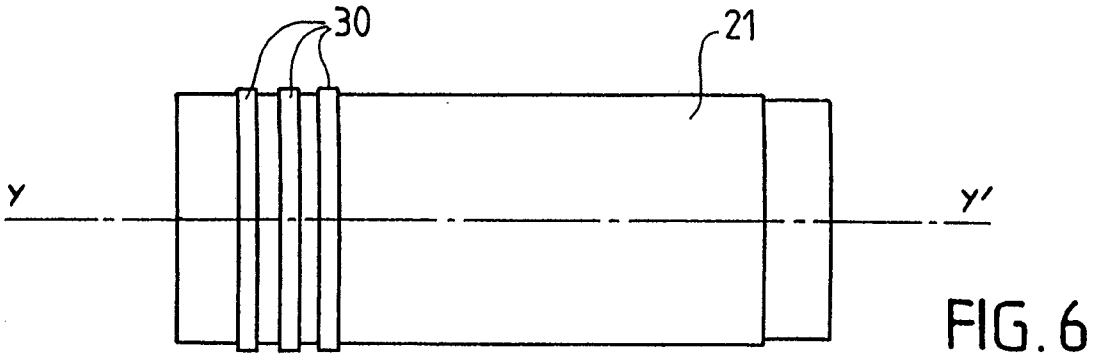
FIG. 6 is an elevational view of an embodiment of the product applying means of FIG. 1.

FIG. 6 is a detail view showing one embodiment of roller 21 which is provided on its surface with circular protrusions, or lands, which effectively increase the thickness of roller 21. These lands 30 have for their effect to thicken the film, or layer, of wax, roller 21 even being able to advantageously have a reduced diameter at its axial ends in order to assure the presence of a bead of wax along each edge of the band which is dispensed via opening 20. These beads, which have a thickness greater than that of the part of the band of wax between the edges, help to facilitate subsequent lifting of the wax strip as a unit during hair removal. Roller 21 can also be provided with ridges, or striations, (not shown) in the longitudinal direction of its axis of rotation y–y' shown in FIG. 6 to promote rotation of roller 21 on the user's skin and to assure thickening of the band of wax.

Roller 21 can be made of any material capable of developing a relatively weak adherence with wax, or with any other thermoplastic material that is to be dispensed, which adherence is in any case weaker than the adherence of the wax, or other thermoplastic material, to the skin, or other surface to which the material is to be applied. Roller 21 could be made of, for example, polypropylene or silicone.

A dispenser according to the invention can be provided with a switch 60 (FIG. 11) capable of applying either one of two voltages between electrodes 10. One of these voltages can have a relatively high value and can be used when the contents of reservoir 8 are at room temperature and are to be heated to the desired operating temperature. The second voltage, which has a lower value than the first voltage, is applied to maintain the thermoplastic material at an average desired application temperature after it has been first heated to that temperature. This arrangement permits the initial delivery of a high level of thermal energy to initially permit a rapid melting of the thermoplastic material contained in reservoir 8, after which a lower level of thermal energy is delivered to maintain the mass at the desired temperature. Alternatively, a similar effect can be achieved if the electrically conductive plastic material of envelope 9 is a material having a high positive thermal coefficient of resistance.

Case 1 is closed at its upper end, remote from opening 20, by a closing plug 31 affixed by any appropriate means.

Figure 11:
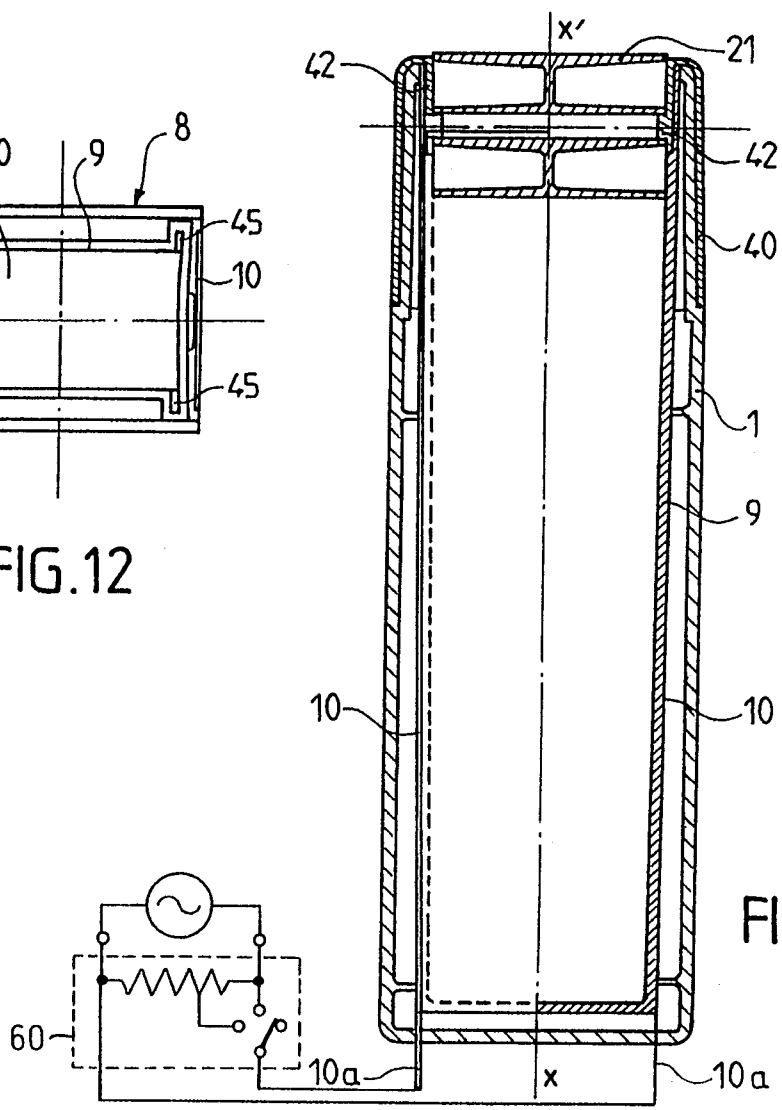
FIG. 11 is a cross-sectional view of the embodiment of FIG. 10, taken along a plane at right angles to the plane of FIG. 10.
Figure 12:
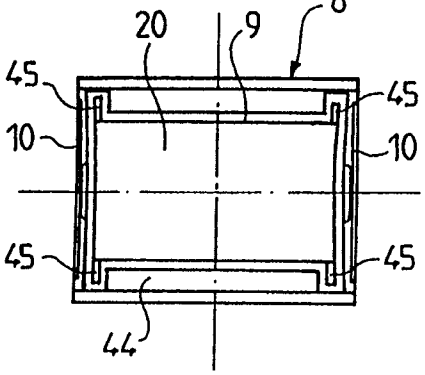
FIG. 12 is a top plan view of the embodiment of FIG. 10.
Figure 10:
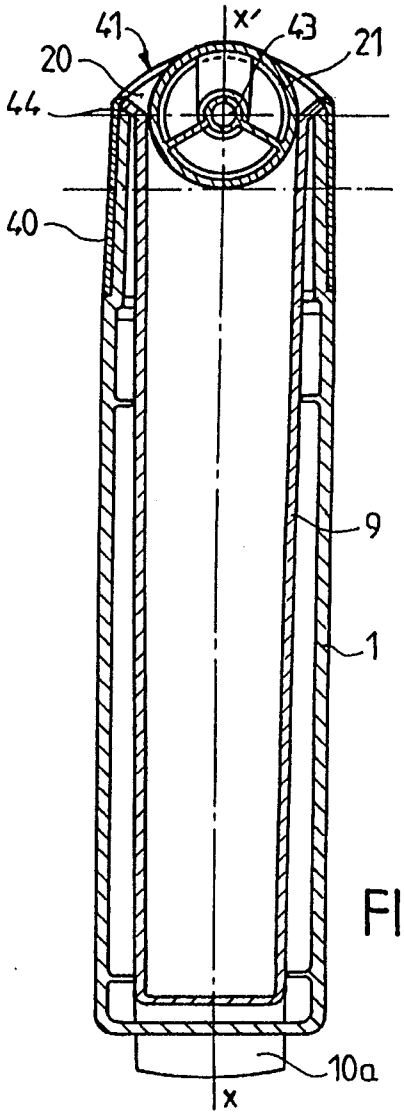
FIG. 10 is an elevational, cross-sectional view of a further embodiment of the invention.

FIGS. 10–12 illustrate another embodiment of the invention which differs from those previously described by the fact that roller 21 is removably installed. In this embodiment, roller 21 is mounted on a cap 40 which is constructed to be slipped over the associated end of case 1 and locked in position, for example by latching or clipping onto walls of case 1. Cap 40 has an opening 41 arranged to be in line with outlet opening 20 and two tongues 42 which are folded over to bear against end faces of envelope 9, at the end of envelope 9 associated with outlet passage 29. Tongues 42 have extremities provided with support elements, for example disks, intended to be inserted into openings or recesses 43 provided along the axis of rotation of roller 21. Cap 40 thus serves as a mean for supporting roller 21, while permitting roller 21 to be removed from cap 40 for purposes of replacement or cleaning, when cap 40 is withdrawn from case 1. The mounting of roller 21 in a removable cap 40 facilitates cleaning of roller 21 and allows reservoir 8 to easily be refilled via outlet passage 20. As a result, the embodiment of FIGS. 10–12 need not be provided with a removable plug or closing element, such as the element 31 of the embodiment of FIGS. 1–3.

According to another alternative of the invention, and as shown in FIGS. 10–12, the walls of reservoir 8 may present, at the level of outlet passage 20, an external collar 44 having outwardly inclined edges. In these edges there are formed at least two, and preferably a total of four, slits 45, which extend through the thickness of the outwardly inclined edges. Slits 45 are preferably arranged at the corners of outlet opening 20 at the level of the junctions between the different sides of envelope 9. Slits 45 permit, during flow of wax in a softened or liquid state, the formation of beads, or thickened edges of the band of wax being deposited. As noted above, the resulting band of wax becomes easier to remove from the user's skin. The provision of four slits 45 enables the device of FIGS. 10–11 to be moved in either one of two directions while applying wax, i.e. to apply wax while roller 21 is rotating in either sense about its axis of rotation, without disturbing the airwax system necessary for a satisfactory application of the wax film or layer.

As shown in FIG. 11, switch 60 may be connectable to a power source and may include a three position switch element connected to a voltage dividing resistor. The switch element may be moved between two voltage applying positions manually or under control of a temperature responsive unit in thermal communication with reservoir 8.

The functioning of a dispenser of thermoplastic products according to the invention will now be described.

The user, after having filled reservoir 8 with the thermoplastic product to be dispensed, for example depilatory wax, initially provided in the form of a relatively solid block of wax, operates switch 60 to apply a voltage between electrodes 10, this preferably being the higher of the two voltages described above if the dispenser has a dual voltage switch. The mass of wax then absorbs heat generated by envelope 11 and the mass of wax, particularly that in the portion of reservoir 8 adjacent roller 21, is progressively softened or liquified, to such an extent that roller 21, which when cold can become stuck to the walls of case 1 or envelope 9, becomes detached therefrom. This detachment then permits the passage of a thin film or layer of wax through opening 20. The user who previously took hold of the dispenser can then begin applying the wax by rolling roller 21 along the skin. The fact of using a heating envelope 9 permits the heating temperature to be distributed in a uniform manner in the entire mass of wax, which assures a rapid temperature increase, followed by an optimal regulation of the wax application temperature.

The possibility of making use of a wax dispenser provided with a mobile applicator roller permits the user to be freed of any concern about uncontrolled flow of the wax into the environment, since roller 21 automatically blocks orifice 20 when the dispenser, and specifically roller 21, is not in contact with the user's skin.

Figure 7:
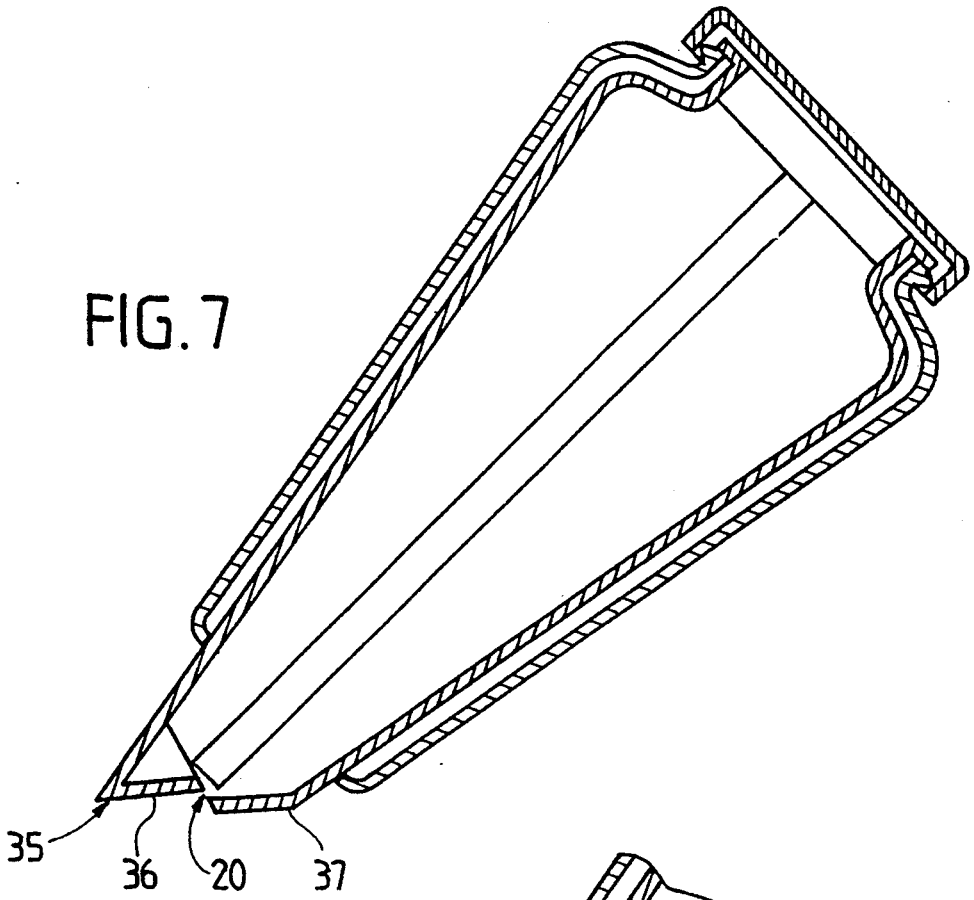
FIG. 7 is an elevational, cross-sectional view of another embodiment of the invention.
Figure 8:
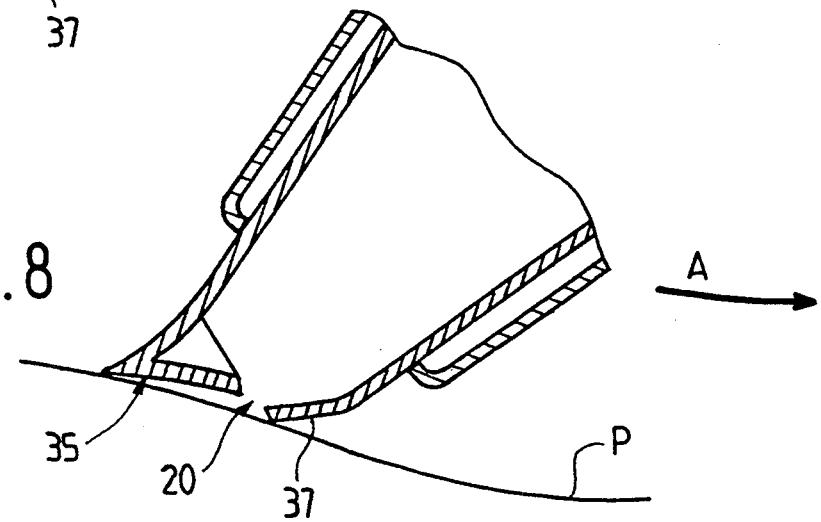
FIG. 8 is an elevational, cross-sectional detail view of a part of the embodiment of FIG. 7 in a condition for applying a product to the user's skin.
Figure 9:
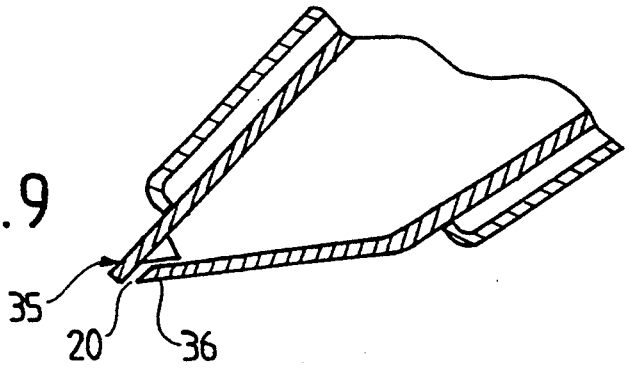
FIG. 9 is a view similar to that of FIG. 8 of a modified version of the embodiment of FIG. 7.

Another variation according to the invention is shown in FIGS. 7–9, differing from those already described in that they include an opening 20 in the form of a slit and by the provision of an applicator means in the form of a deformable tip 35. Thus, in the arrangements shown in FIGS. 7–9, there is no roller. Deformable tip 35 has a lower face 36 which contacts the skin surface during application of a wax film. In lower face 36 there is provided a slit 20' preferably having a rectangular outline. When the user presses tip 35 against skin P, the application force permits tip 35 to be deformed in a manner to enlarge the opening provided by slit 20', as shown in FIG. 8. Melted or softened wax can then flow via the opening defined by slit 20' and is spread by the forward part of the lower application surface 36. Advantageously, the rear part of application face 36, forming a heel 37, extends in a plane which is substantially offset toward the bottom with respect to a plane which forms an extension of the forward part of application face 36. This relationship has for its effect to facilitate flow of a film of wax during displacement of the dispenser in the direction of arrow A of FIG. 8. FIG. 9 shows a variation of the embodiment of FIGS. 7 and 8 in which orifice 20' in the form of a slit is disposed in the vicinity of the forward part of application face 36.

In further accordance with the invention, thermal regulation of the dispenser can be promoted by giving envelope 9 a variable thickness, and in particular a greater thickness in the vicinity of outlet opening, and for example at the level of section 2 and/or section 3. Increasing the thickness of envelope 9 at the level of outlet orifice 20 can be effected in a continuous or discontinuous manner, i.e. it can be regular or nonregular, or gradual or abrupt. To this end, there can be provided a series of internal ribs, or ridges (not shown in the drawings) in the thickness dimension of envelope 9 in order to increase at intervals the electric power dissipated and the conduction between opposed electrodes 10.

According to a further embodiment of the invention, it is possible to mount roller 21 on a rigid support if the material of case 1 cannot, because of its flexibility, properly support said roller.

This application relates to subject matter disclosed in French Application number 9212378, filed on Oct. 9, 1992, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. A dispenser for dispensing a thermoplastic product in a fluid state, said dispenser comprising: a case having manual holding means; a reservoir composed of a wall forming an enclosure for holding a supply of the product, said reservoir having an outlet opening; heating means in heat transfer communication with said reservoir; and a product applicator disposed in proximity to said reservoir opening for receiving product in a fluid state from said reservoir, wherein at least a portion of said reservoir wall comprises an electrically conductive plastic constituting said heating means, and said dispenser further comprises electrodes connected to said electrically conductive plastic of said reservoir portion for delivering heating current to said heating means.

2. A dispenser as defined in claim 1 wherein said reservoir wall is composed substantially entirely of said electrically conductive plastic.

3. A dispenser as defined in claim 1 wherein said case surrounds said reservoir, and wherein said dispenser further comprises thermal insulating means disposed for thermally insulating said case from said reservoir.

4. A dispenser as defined in claim 1 further comprising a plurality of ribs extending from said case and bearing against said reservoir to define, between said ribs, closed air spaces which thermally insulate said case from said reservoir.

5. A dispenser as defined in claim 1 wherein said electrodes comprise two metal bands or screens.

6. A dispenser as defined in claim 5 wherein said electrodes are molded into said reservoir wall.

7. A dispenser as defined in claim 5 wherein said electrodes are electrolytically deposited or printed onto said reservoir wall.

8. A dispenser as defined in claim 1 wherein said reservoir wall portion of plastic has a nonuniform thickness.

9. A dispenser as defined in claim 8 wherein said reservoir wall portion of plastic extends to a location adjacent said outlet opening and has a greater thickness adjacent said outlet opening than at a location spaced from said outlet opening.

10. A dispenser as defined in claim 1 wherein said electrically conductive plastic is a material selected from: a carbon-filled elastomer; a carbon-filled polypropylene; and a conductive polymer.

11. A dispenser as defined in claim 1 wherein said electrically conductive plastic is a material having a high positive temperature coefficient of resistance.

12. A dispenser as defined in claim 1 further comprising heating current supply means for delivering a heating current to said electrodes, said heating current supply means comprising means for selectively delivering current having a first magnitude when said reservoir has not been heated to a desired temperature and having a second magnitude when said reservoir is at the desired temperature.

13. A dispenser as defined in claim 1 wherein said product applicator is a roller supported by one of said case and said reservoir at a location to face said outlet opening.

14. A dispenser as defined in claim 13 further comprising means supporting said roller for permitting said roller to be displaced by the force of gravity to a position in which said roller seals said outlet opening.

15. A dispenser as defined in claim 14 wherein said roller has an axis of rotation and a shaft coaxial with said axis of rotation, and said means supporting said roller comprise support elements having grooves in which said shaft engages and which form slideways for said shaft.

16. A dispenser as defined in claim 1, further comprising a removable cap attachable to said case in a manner to support said product dispenser.

17. A dispenser as defined in claim 16 wherein said cap comprises: means for latching said cap onto said case; and two projecting elements for supporting said product dispenser.

18. A dispenser as defined in claim 1 wherein said reservoir is provided, adjacent said outlet opening, with at least two slits for passage of the product.

19. A dispenser as defined in claim 1 wherein said outlet opening has the form of a slit, and said product applicator comprises a resiliently deformable tip integral with said reservoir and located to bear against a user's skin, when said dispenser is in use, said tip being deformable to enlarge or shrink said slit.

20. A method of applying a depilatory wax to a person's skin, using the device of claim 1, comprising: filling the reservoir with a mass of depilatory wax, supplying electric current to the electrodes for causing the heating means to heat the wax to a fluid state; and placing the product dispenser against the skin while allowing wax in the fluid state to flow out of the reservoir through the outlet opening.

* * * * *